US006500227B1

(12) United States Patent
Asai et al.

(10) Patent No.: US 6,500,227 B1
(45) Date of Patent: Dec. 31, 2002

(54) PROCESS FOR PRODUCTION OF ULTRAFINE NICKEL POWDER

(75) Inventors: Tsuyoshi Asai, Chigasaki (JP); Hideo Takatori, Chigasaki (JP)

(73) Assignee: Toho Titanium Co., Ltd., Chigasaki (JP)

( * ) Notice: Subject to any disclaimer, the term of this patent is extended or adjusted under 35 U.S.C. 154(b) by 0 days.

(21) Appl. No.: 09/720,486

(22) PCT Filed: Jun. 8, 2000

(86) PCT No.: PCT/JP00/03729

§ 371 (c)(1),
(2), (4) Date: Jan. 23, 2001

(87) PCT Pub. No.: WO00/74881

PCT Pub. Date: Dec. 14, 2000

(30) Foreign Application Priority Data

Jun. 8, 1999 (JP) ..... 11-160871

(51) Int. Cl.[7] ..... B22F 1/00
(52) U.S. Cl. ..... 75/367; 75/369; 75/374
(58) Field of Search ..... 75/363, 367, 369, 75/374

(56) References Cited

U.S. PATENT DOCUMENTS

| | | | | |
|---|---|---|---|---|
| 4,383,852 A | | 5/1983 | Yoshizawa | |
| 5,853,451 A | * | 12/1998 | Ishikawa | 75/367 |
| 6,235,077 B1 | * | 5/2001 | Kagohashi et al. | 75/369 |
| 6,372,015 B1 | * | 4/2002 | Asai et al. | 75/363 |

FOREIGN PATENT DOCUMENTS

| | | | | |
|---|---|---|---|---|
| EP | 0 461 866 A2 | | 12/1991 | |
| EP | 0 887 133 A1 | | 12/1998 | |
| JP | 62-192507 | * | 8/1987 | 75/367 |
| JP | 64-36706 | | 2/1989 | |
| JP | 2-284643 | * | 11/1990 | 75/367 |
| JP | 5-247507 | | 9/1993 | |
| JP | 8-246001 | | 9/1996 | |
| JP | 10-66863 | | 3/1998 | |

* cited by examiner

*Primary Examiner*—George Wyszomierski
(74) *Attorney, Agent, or Firm*—Oliff & Berridge, PLC

(57) ABSTRACT

In a process for production of ultrafine nickel powder, raw material gas having a partial pressure of nickel chloride vapor within a range from 0.2 to 0.7 is fed into a reducing furnace and the nickel chloride vapor is reduced with hydrogen while flowing the raw material gas in this reducing furnace at a space velocity (SV) within a range from 0.02 to 0.07 $sec^{-1}$.

4 Claims, 3 Drawing Sheets

PROCESS FOR PRODUCTION OF ULTRAFINE NICKEL POWDER

TECHNICAL FIELD

The present invention relates to a process for production of ultrafine nickel powder in which ultrafine nickel powder having an average particle diameter of 1.0 μm or less can be produced by reducing raw material gas including nickel chloride vapor with hydrogen, and in particular, relates to a technique in which the quality of the ultrafine nickel powder can be improved while the productivity thereof is maintained at a high level.

BACKGROUND ART

Conductive metal powders such as nickel, copper, silver, palladium, etc., are useful for internal electrodes in multilayer ceramic capacitors, and in particular, since nickel powder, which is a base metal, is inexpensive, such application has recently attracted attention. As a process for production of such a nickel powder, a process in which nickel chloride vapor is generated and is reduced with hydrogen charged into a reducing furnace is known. In addition, multilayer ceramic capacitors generally have a construction such that ceramic dielectric layers and metallic layers used for internal electrodes are alternately laminated. Recently, reduced thickness and reduced resistance in the internal electrode, etc., are required for miniaturization and capacity increase of the capacitors, and therefore, the average particle diameter of the ultrafine powders is preferably 1.0 μm or less, more preferably 0.5 μm or less, and most preferably 0.1 to 0.4μm.

In order to reduce the particle diameter of the nickel powder, it is necessary that the residence time of the nickel chloride vapor in hydrogen be shortened, and in addition, it is necessary that the nickel powder be formed so as to be as spherical as possible, that the particle diameter thereof be made uniform, and that the desired particle diameter be obtained. Furthermore, in order to increase the production yield of the nickel powder, it is effective for the flow rate of raw material gas fed into the reducing furnace to be increased or for the partial pressure of the nickel chloride vapor in the raw material gas to be increased; however, stabilization of quality and further improvement thereof are then difficult.

Therefore, an object of the present invention is to provide a process for production of ultrafine nickel powder in which the following targets can be met.

① Ultrafine nickel powder is produced in which the average particle diameter thereof is preferably 1.0 μm or less, and more preferably 0.1 to 0.4 μm.

② Qualities such as uniformity of shape and particle diameter of the ultrafine nickel powders are improved, while manufacturing efficiency is maintained at a high level.

DISCLOSURE OF THE INVENTION

The inventors have performed intensive research with regard to the conditions under which the raw material gas is fed into the reducing furnace. As a result, they have discovered suitable conditions which can meet the above targets. That is, a first process for production of ultrafine nickel powder, in which ultrafine nickel powders are produced by vapor-reducing nickel chloride vapor, is characterized in that raw material gas having a partial pressure of nickel chloride vapor within a range from 0.2 to 0.7 is fed into a reducing furnace, and the nickel chloride vapor is reduced with hydrogen while flowing the raw material gas in this reducing furnace at a space velocity (SV) within a range from 0.02 to 0.07 $sec^{-1}$.

In addition, a second process for production of ultrafine nickel powder, in which ultrafine nickel powders are produced by vapor-reducing nickel chloride vapor, is characterized in that hydrogen is discharged from a first outlet nozzle provided at an inlet nozzle of a reducing furnace, raw material gas having a partial pressure of nickel chloride vapor within a range from 0.2 to 0.7 is simultaneously discharged from a second outlet nozzle provided so as to surround the first outlet nozzle, and the nickel chloride vapor is reduced with hydrogen while flowing the raw material gas in this reducing furnace at a space velocity (SV) within a range from 0.02 to 0.07 $sec^{-1}$.

More preferred embodiments of the above first or second production processes are as follows.

① Raw material gas having a partial pressure of nickel chloride vapor within a range from 0.3 to 0.7 is fed into a reducing furnace and the nickel chloride vapor is reduced with hydrogen while flowing the raw material gas in the reducing furnace at a space velocity (SV) within a range from 0.025 to 0.07 $sec^{-1}$ .

② In order to obtain ultrafine nickel powders having an average particle diameter within a range from 0.1 to 0.2 μm, raw material gas having a partial pressure of nickel chloride vapor within a range from 0.25 to 0.6 is fed into a reducing furnace and the nickel chloride vapor is reduced with hydrogen while flowing the raw material gas in this reducing furnace at a space velocity (SV) within a range from 0.03 to 0.07 $sec^{-1}$, and it is preferable that raw material gas having a partial pressure of nickel chloride vapor within a range from 0.3 to 0.55 be fed into a reducing furnace and that the nickel chloride vapor be reduced with hydrogen while flowing the raw material gas in the reducing furnace at a space velocity (SV) within a range from 0.035 to 0.07 $sec^{-1}$.

③ In order to obtain ultrafine nickel powders having an average particle diameter within a range from 0.25 to 0.4 μm, raw material gas having a partial pressure of nickel chloride vapor within a range from 0.3 to 0.7 is fed into a reducing furnace and the nickel chloride vapor is reduced with hydrogen while flowing the raw material gas in the reducing furnace at a space velocity (SV) within a range from 0.02 to 0.06 $sec^{-1}$, and it is preferable that the raw material gas having a partial pressure of nickel chloride vapor within a range from 0.3 to 0.7 be fed into the reducing furnace and that the nickel chloride vapor be reduced with hydrogen while flowing the raw material gas in the reducing furnace at a space velocity (SV) within a range from 0.03 to 0.06 $sec^{-1}$.

④ Raw material gas is discharged from a second outlet nozzle to a reducing furnace at a linear velocity within a range from 0.5 to 5.0 m/second.

⑤ Hydrogen is discharged from a first outlet nozzle provided at an inlet nozzle of a reducing furnace, and raw material gas is discharged from a second outlet nozzle provided around the first outlet nozzle. At this time, hydrogen at 30 to 100 mol % of the theoretical amount required to reduce nickel chloride vapor is discharged from the first outlet nozzle.

In the following, preferred embodiments of the present invention will be explained in detail. Terms used in the present description are defined as follows.

① "Raw material gas" refers to a gas in which nickel chloride vapor is diluted with inert gas and/or halogen gas such as chlorine gas and which is a mixture as a raw material to be reduced. Inert gas or halogen gas acts to dilute the nickel chloride vapor and/or as a carrier thereof. As the inert gas, nitrogen gas or argon gas is generally employed, and in addition, the gas can also be employed with halogen gas in combination.

② The "partial pressure of nickel chloride vapor" refers to the mole percentage of the nickel chloride vapor occupied in a mixture of nickel chloride vapor with inert gas and/or halogen gas.

③ "Space velocity" is indicated by SV (space velocity; units: $sec^{-1}$) and refers to a ratio of feeding speed (liter/second; conversion at reduction temperature and at 1 atm) of nickel chloride vapor fed into a reducing furnace to volume V (liters) of a reacting portion in the reducing furnace (volume of a space from an inlet nozzle portion of raw material gas to a cooling portion for cooling formed ultrafine nickel powder). Although the nickel chloride vapor is fed as a mixture of inert gas and/or halogen gas, SV is the value for nickel chloride excepting the inert gas.

④ "Linear velocity" refers to the discharging speed (m/second; conversion at reduction temperature) of raw material gas in the case in which the raw material gas is fed from a second outlet nozzle to a reducing furnace.

A. Raw Material Gas

As a process for production of nickel chloride vapor which is a component of raw material gas to be reduced, a process in which solid nickel chloride is evaporated by heating, or a process in which nickel metal is brought into contact with chlorine gas, thereby converting it into a metal chloride, can be employed. In particular, the latter process is preferably adopted in the present invention since the production amount of nickel chloride is easily controlled by feeding a set amount of chlorine. As raw material gas fed into the reducing furnace in the present invention, a mixture of nickel chloride vapor with halogen gas and/or an inert gas is preferred. The partial pressure of nickel chloride vapor is preferably 0.2 to 0.7, is more preferably 0.25 to 0.7, and is most preferably 0.3 to 0.7. The range of such partial pressures is a preferable aspect in the case in which an objective ultrafine nickel powder having qualities such as particle diameter, uniformity thereof, shape, crystallinity, sinterability, etc., is produced.

B. Reducing Furnace

B-1. Overall Composition

FIG. 1 shows an example of a reducing furnace 10 used in the present invention; however, the present invention is not limited to this. At the top of the reducing furnace 10, a raw material gas feeding nozzle 30 connected with a raw material gas feeding pipe 42 is provided, and in addition, a hydrogen feeding pipe 20 is provided at another portion. Furthermore, a cooling gas feeding pipe 11 is provided. A space between a tip (shown by 13*a* in the figure) of the raw material gas feeding nozzle 30 and a position (shown by 13*b* in the figure) of the cooling gas feeding pipe 11 is a reaction portion 12. The ultrafine nickel powder produced by a reductive reaction is conveyed to a separation and collection process and to a purification process with surplus hydrogen and by-product hydrogen chloride.

B-2. Feeding Process for Raw Material Gas and Hydrogen

The raw material gas discharging nozzle 30 may be a single pipe, as is shown in FIG. 1, and may branch into two or more branches. The discharging speed of the raw material gas from a raw material gas outlet nozzle, that is, the linear velocity, is desirably set for 0.5 to 5.0 m/second (calculated value converted at the reduction temperature). In the case in which the line velocity is above this range, the reductive reaction becomes nonuniform.

In order to satisfy both productivity and quality requirements for the ultrafine nickel powder, a double-pipe structure (often referred to as a "multi-nozzle") which provides a hydrogen discharging nozzle 24 in the raw material gas discharging nozzle 30, as is shown in FIG. 2, is preferred. Thus, the reductive reaction for nickel chloride can thereby be carried out more efficiently. As another aspect, nozzles in which multiple raw material gas outlet nozzles are divided around the hydrogen discharging nozzle 24 at the center may be used. According to such an arrangement, nickel chloride vapor is fed from the raw material gas outlet nozzle extremely stably, uniformly, and efficiently so as to react with hydrogen, and ultrafine nickel powder in which the particle diameter distribution is small can thereby be obtained even at high partial pressures of nickel chloride vapor.

B-3. Feeding Amount of Hydrogen

The total amount of hydrogen fed into the reducing furnace is a theoretical amount (chemical equivalent) or more, which is necessary for reducing nickel chloride in the raw material, and specifically, hydrogen of 110 to 200 mol % of the theoretical amount is fed. In the case in which the double-pipe nozzle is used, as shown in FIG. 2, it is preferable, in order to accomplish the object of the present invention, that hydrogen of 30 to 100 mol % of the theoretical amount be fed from the hydrogen discharging nozzle 24 provided at the center and that the remainder which is required be fed from the hydrogen feeding pipe 20 so that the total amount is 110 to 200 mol %. Although there is no problem even if hydrogen is fed above 200 mol % of the theoretical amount, this case is economically inferior. As a preferable aspect, it is particularly effective that 40 to 90 mol % of the theoretical amount be fed from the hydrogen discharging nozzle 24 using the double-pipe shown in FIG. 2, and that 30 to 90 mol % thereof be separately fed from the hydrogen feeding pipe 20, so that the total hydrogen feeding amount is 110 to 180 mol % of the theoretical value.

B-4. Reaction Condition and Space Velocity

The reductive reaction in the reducing furnace is carried out in the reaction portion 12 at 950 to 1150 ° C. When raw material gas having a partial pressure of nickel chloride vapor within a range from 0.2 to 0.7 is fed from the raw material gas outlet nozzle to the reducing furnace, nickel chloride vapor immediately brings into contact with hydrogen, and a core of nickel is formed and grows. Then, it is rapidly cooled by feeding inert gas from the cooling gas feeding pipe 11 provided at the lower portion of the reducing furnace, etc., and growth thereof is stopped. The ultrafine nickel powder produced by such a procedure is conveyed to a separation and collection process.

In the present invention, it is important to combine the partial pressure of nickel chloride vapor in the raw material gas with a setting of 0.02 to 0.07 $sec^{-1}$ for the space velocity (SV) of the nickel chloride vapor in the reaction portion 12 from the outlet nozzle of the raw material gas feeding nozzle 30 to the cooling portion. In the case in which the space velocity (SV) is below 0.02 $sec^{-1}$, manufacturing efficiency is extremely low. In contrast, in the case in which it is above 0.07 $sec^{-1}$, the quality of the ultrafine nickel powder is tends to be unstable. The space velocity (SV) is preferably 0.025 to 0.07 $sec^{-1}$, if conditions are further limited from this viewpoint.

FIG. 3 shows the relationship between partial pressure of nickel chloride vapor and space velocity (SV) thereof to the average particle diameter of the produced ultrafine nickel powder. As is apparent from FIG. 3, in order to control the average particle diameter, ranges of partial pressure of nickel chloride vapor in raw material gas and space velocity (SV) are set as mentioned above, and ultrafine nickel powder having an average particle diameter within a range from 0.1 to 0.2 μm or an average particle diameter within a range from 0.25 to 0.4 μm can thereby be selectively produced.

① In particular, in order to produce ultrafine nickel powder having an average particle diameter within a range from 0.1 to 0.2 μm, raw material gas having a partial pressure of nickel chloride vapor within a range from 0.25 to 0.6 is fed into a reducing furnace and the nickel chloride vapor is reduced with hydrogen while flowing the raw material gas in the reducing furnace at a space velocity (SV) within a range from 0.03 to 0.07 $sec^{-1}$. It is more preferable that raw material gas having a partial pressure of nickel chloride vapor within a range from 0.3 to 0.55 be fed into a reducing furnace and that the nickel chloride vapor be reduced with hydrogen while flowing the raw material gas in this reducing furnace at a space velocity (SV) within a range from 0.035 to 0.07 $sec^{1}$.

② In order to produce ultrafine nickel powder having an average particle diameter within a range from 0.25 to 0.4 μm, raw material gas having a partial pressure of nickel chloride vapor within a range from 0.3 to 0.7 is fed into a reducing furnace and the nickel chloride vapor is reduced with hydrogen while flowing the raw material gas in the reducing furnace at a space velocity (SV) within a range from 0.02 to 0.06 $sec^{-1}$. It is more preferable that raw material gas having a partial pressure of nickel chloride vapor within a range from 0.3 to 0.7 be fed into a reducing furnace and that the nickel chloride vapor be reduced with hydrogen while flowing the raw material gas in this reducing furnace at a space velocity (SV) within a range from 0.03 to 0.06 $sec^{-1}$.

③ Even if the average particle diameter is the same, in the case in which the partial pressure of nickel chloride vapor is low, or in the case in which the space velocity (SV) is small, crystallinity of the produced ultrafine nickel powder is superior and the below-described sinterability is also improved. In this case, since productivity is lowered, partial pressure and space velocity (SV) are appropriately set in consideration of a balance of quality and properties.

As a more preferable aspect, hydrogen is brought into contact with raw material gas and is simultaneously discharged in the reducing furnace, and a reductive reaction is carried out at the above partial pressure of nickel chloride vapor in raw material gas and a space velocity (SV) thereof.

BEST MODE FOR CARRYING OUT THE INVENTION

EXAMPLE 1

In the following, the present invention will be further explained in detail according to specific examples.

Figure 1:
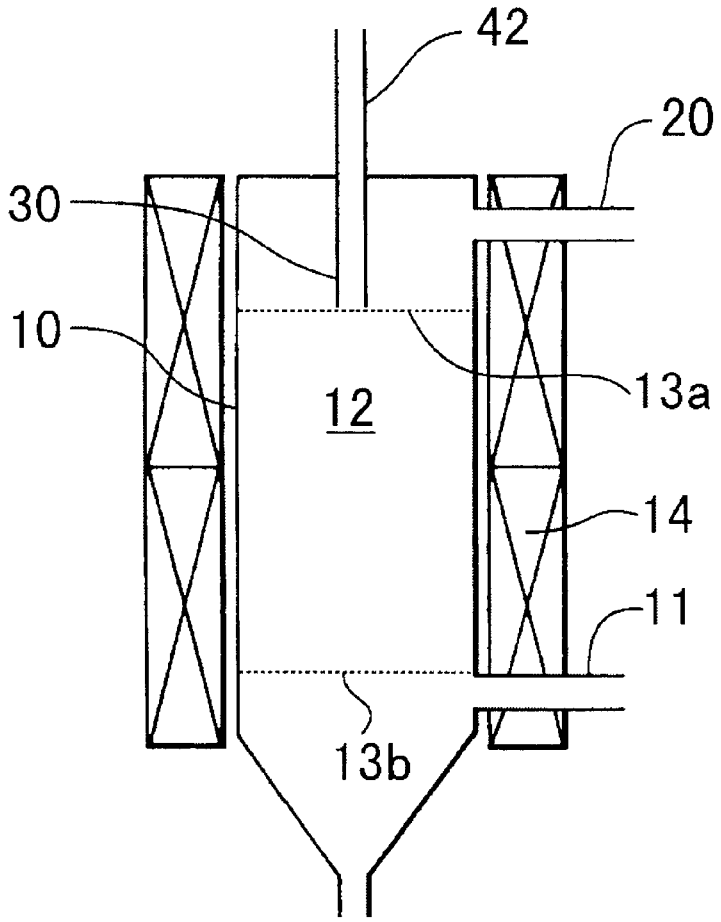
FIG. 1 is a vertical cross sectional view showing a reducing furnace according to an embodiment of the present invention.

A single pipe nozzle was installed in a reducing furnace shown in FIG. 1, and then a reaction was carried out under conditions shown in Table 1. Physical properties of the obtained ultrafine nickel powder are shown in Table 1.

① The average particle diameter of the ultrafine nickel powder was measured by a BET method.

② The shape of the ultrafine nickel powder was observed by an electron microscope.

③ X-ray diffraction was carried out on the ultrafine nickel powder. Cases where a peak in the diffraction pattern was clear were judged as having superior crystallinity, and cases where the peak was unclear were judged as having inferior crystallinity.

④ A pellet was press-formed using the ultrafine nickel powder, and the sinterability was evaluated by measuring the temperature when the volume thereof had changed by heating the pellet (start of sintering). In the case in which the temperature is high when a multilayer ceramic capacitor is formed, stable sintering is carried out and superior sinterability is exhibited.

⑤ Photographs of samples were taken by an electron microscope, particle diameters of 200 powders were measured, and CV values of particle diameter distributions were thereby calculated (standard deviation of particle diameter/average particle diameter).

As is apparent from Table 1, the ultrafine nickel powder of Example 1 was a spherical powder having an average particle diameter of 0.21 μm, and superior results were exhibited with respect to crystallinity, sinterability, and particle diameter distribution.

TABLE 1

| | Example 1 | Example 2 |
|---|---|---|
| Production Conditions | | |
| Flow Rate of Nickel Chloride Vapor (Nl/min) | 3.5 | 2.5 |
| Flow Rate of Nitrogen Gas for Diluting (Nl/min) | 5.0 | 10.0 |
| Partial Pressure of Nickel Chloride Vapor | 0.41 | 0.2 |
| Flow Rate of Hydrogen (Nl/min) | 5.0*1) | 5.0*2) |
| Reduction Temperature (° C.) | 1000 | 1000 |
| Space Velocity of Nickel Chloride Vapor (1/second) | 0.04 | 0.03 |
| Measurement Results | | |
| Average Particle Diameter of Ultrafine Nickel Powder (μm) | 0.21 | 0.20 |
| Shape | Sphere | Sphere |
| Crystallinity | Superior | Superior |
| Sinterability (° C.) | 470 | 550 |
| Particle Diameter Distribution (CV Value, %) | 30 | 20 |

*1): Case in which raw material gas is fed from a hydrogen feeding pipe 20.
*2): Case in which raw material gas is fed from a hydrogen discharging nozzle 24 at 1.0 Nl/min and from a hydrogen feeding pipe 20 at 4.0 Nl/min.

EXAMPLE 2

Figure 2:
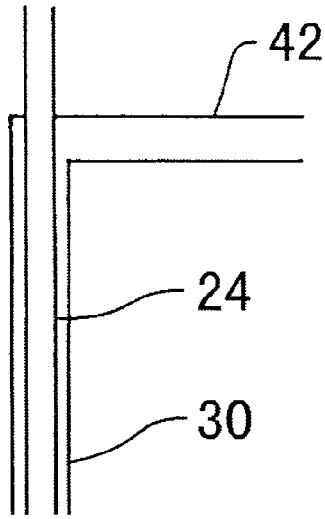
FIG. 2 is a vertical cross sectional view showing an example in which a raw material gas feeding nozzle is constituted as a double-pipe nozzle according to an embodiment of the present invention.
Figure 3:
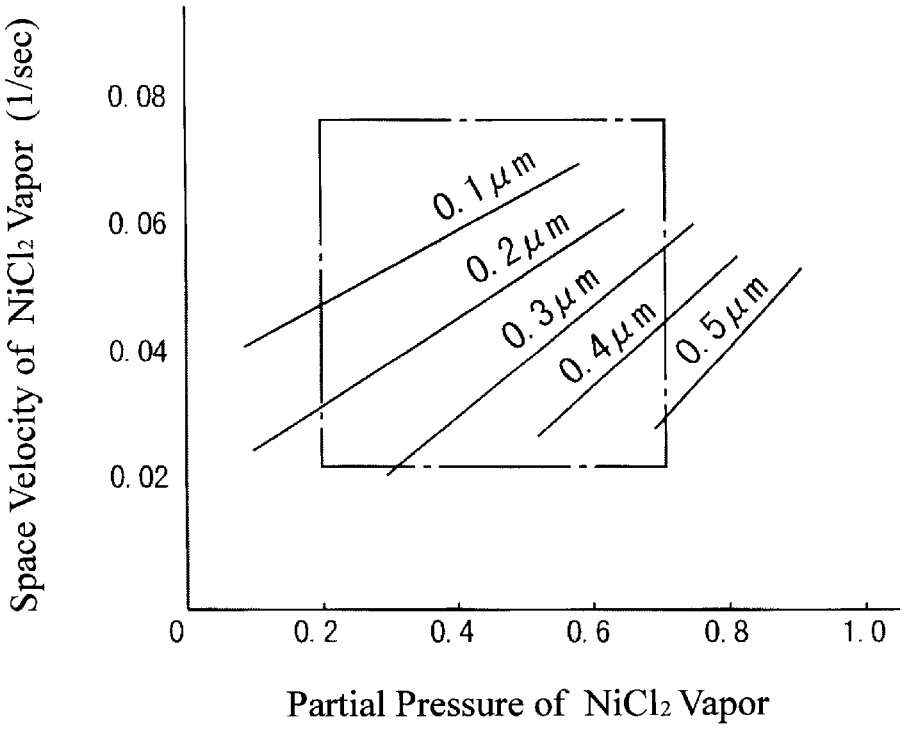
FIG. 3 is a graph showing relationships between partial pressure of nickel chloride vapor and a space velocity (SV) thereof for each average particle diameter of the produced ultrafine nickel powders.

Next, the double-pipe nozzle of FIG. 2 was installed in the reducing furnace used in Example 1, and the reaction was carried out under conditions shown in Table 1. Physical properties of obtained ultrafine nickel powders are also described in Table 1. As is apparent from Table 1, since the reductive reaction is uniformly generated, sinterability and particle diameter distribution could be further improved, and in addition, ultrafine nickel powders having desired average particle diameter, shape, and superior crystallinity were obtained.

As is explained above, according to the present invention, when the partial pressure of nickel chloride vapor and space velocity (SV) of nickel chloride vapor are set in suitable ranges, the following superior effects can thereby be obtained.

① Ultrafine nickel powder having an average particle diameter of 0.4 $\mu$m or less, in which crystallinity, shape, and sinterability are superior, can be produced.

② Raw material gas is fed with hydrogen from a double-pipe nozzle, and the sinterability and particle diameter distribution can thereby be further improved.

③ Even if the partial pressure of nickel chloride vapor is high, ultrafine nickel powder having superior quality can be produced and the productivity thereof is remarkably high. In addition, ultrafine powder having an extremely small particle diameter can be obtained.

What is claimed is:

1. A process for production of ultrafine nickel powder, comprising:

feeding raw material gas having a partial pressure of nickel chloride vapor within a range of from 0.3 to 0.7 into a reducing furnace; and reducing said nickel chloride vapor with hydrogen while flowing said nickel chloride vapor in said reducing furnace at a space velocity (SV) within a range of from 0.02 to 0.07 $sec^{-1}$;

wherein the linear velocity at a reduction temperature is 0.5 to 5.0 m/second when said raw material gas is discharged to said reducing furnace.

2. A process for production of ultrafine nickel powder as recited in claim 1, wherein hydrogen of 110 to 200 mol % of a theoretical amount required to reduce said nickel chloride vapor is discharged to said reducing furnace.

3. A process for production of ultrafine nickel powder, comprising:

discharging hydrogen from a first outlet nozzle provided at an inlet nozzle of a reducing furnace;

simultaneously discharging raw material gas having a partial pressure of nickel chloride vapor within a range of from 0.3 to 0.7 from a second outlet nozzle provided so as to surround said first outlet nozzle; and reducing said nickel chloride vapor with hydrogen while flowing said nickel chloride vapor in said reducing furnace at a space velocity (SV) within a range of from 0.02 to 0.07 $sec^{-1}$;

wherein the linear velocity at a reduction temperature is 0.5 to 5.0 m/second when said raw material gas is discharged to said reducing furnace.

4. A process for production of ultrafine nickel powder as recited in claim 3, wherein hydrogen of 30 to 100 mol % of a theoretical amount required to reduce said nickel chloride vapor is discharged from said first outlet nozzle.

* * * * *